United States Patent [19]

Yamaguchi

[11] Patent Number: 4,915,853

[45] Date of Patent: Apr. 10, 1990

[54] METHOD FOR FIRE EXTINGUISHMENT OF HARDLY EXTINGUISHABLE DANGEROUS MATERIAL

[75] Inventor: Hisayoshi Yamaguchi, Tokyo, Japan

[73] Assignee: Shin-Etsu Handotai Co., Ltd., Tokyo, Japan

[21] Appl. No.: 291,046

[22] Filed: Dec. 28, 1988

[30] Foreign Application Priority Data

| | | | |
|---|---|---|---|
| Dec. 28, 1987 | [JP] | Japan | 62-335445 |
| Mar. 14, 1988 | [JP] | Japan | 63-59585 |
| Mar. 29, 1988 | [JP] | Japan | 63-75401 |

[51] Int. Cl.[4] ..... c09K 21/00

[52] U.S. Cl. ..... 252/2; 252/7; 252/381; 169/46; 169/47

[58] Field of Search ..... 252/2, 5, 4, 7, 381; 169/45, 46; 106/18.13, 18.3; 75/96

[56] References Cited

U.S. PATENT DOCUMENTS

| | | | |
|---|---|---|---|
| 2,880,172 | 3/1959 | McCutchan | 252/2 |
| 3,055,435 | 9/1962 | Warnock et al. | 169/31 |
| 3,367,863 | 2/1968 | Cooper et al. | 252/2 |
| 3,464,921 | 9/1969 | Erler et al. | 252/2 |
| 3,523,893 | 8/1970 | Lobos | 252/5 |
| 3,565,801 | 2/1971 | Birchall et al. | 252/3 |
| 3,673,088 | 6/1972 | Clements | 252/2 |
| 3,947,365 | 3/1976 | Cottrell et al. | 252/5 |
| 3,958,658 | 10/1976 | Riley et al. | 252/7 |
| 4,042,521 | 8/1977 | Dunn | 252/5 |
| 4,177,152 | 12/1979 | Sarrut | 252/2 |
| 4,377,955 | 11/1969 | Hiltz | 252/4 |
| 4,725,382 | 2/1988 | Lewchalermwong | 252/607 |
| 4,756,839 | 7/1988 | Curzon et al. | 252/2 |

FOREIGN PATENT DOCUMENTS

| | | |
|---|---|---|
| 1063207 | 3/1967 | United Kingdom . |

OTHER PUBLICATIONS

Navy Technical Disclosure Bulletin, vol. 10, No. 4, Jun. 1985, p. 99, "Method of Extinguishing Large Lithium Metal Fires" R. F. Kubin et al.

*Primary Examiner*—Howard J. Locker
*Attorney, Agent, or Firm*—Jules E. Goldberg

[57] ABSTRACT

An efficient method for extinguishing fire of various hardly extinguishable materials is proposed. The method comprises sprinkling, over the burning site of the material, a boron oxide powder having a putity relative to the content of $B_2O_3$ of at least 90% by weight and containing water in an amount not exceeding 2% by weight, the particles of the powder having a diameter in the range from 5 μm to 1000 μm. The efficiency of fire extinguishment with the boron oxide powder can be further enhanced by blending the boron oxide powder with a variety of inert inorganic powders.

14 Claims, No Drawings

METHOD FOR FIRE EXTINGUISHMENT OF HARDLY EXTINGUISHABLE DANGEROUS MATERIAL

BACKGROUND OF THE INVENTION

The present invention relates to a method for fire extinguishing agent of certain dangerous combustible materials of which the fire can hardly be extinguished with conventional fire extinguishment agents when the material is once set on fire.

The hardly fire-extinguishable materials as the objective material of the present invention include those belonging to the following five groups of which (1) the first group includes powders of various metals such as magneisum, aluminum, zinc, titanium, zirconium, iron and the like, (2) the second group includes alkali metals such as sodium, potassium lithium and the like, (3) the third group includes water-prohibiting materials, i.e. materials which produce inflammable gases or evolve a large quantity of heat when contacted with water, such as calcium carbide, calcium phosphide, calcium oxide and the like, (4) the fourth group includes highly combustible inorganic solid materials such as red phosphorus, yellow phosphorus, sulfur, phosphorus sulfide and the like and (5) the fifth group include highly combustible liquid materials such as alkyl aluminums, alkyl lithiums, chlorosilanes, diketene and the like.

The materials of the first group, i.e. magnesium, aluminum, titanium and the like, are combustible and possibly explosive when they are in the form of a fine powder and may sometimes result in very serious hazards when a large amount thereof is set on fire. When the metal powder at a high temperature is brought into contact with water, a reaction may take place between the metal and water to produce hydrogen gas which causes explosion to scatter the metal powder so that water as a most conventional fire extinguishing agent can never be used when such a metal powder is set on fire. Other conventional fire extinguishing agents such as carbon dioxide gas, Halons and powder fire extinguishing agents are also ineffective for fire extinguishment thereof. The only known means having some effectiveness for fire extinguishment of fire on these metal powders is to sprinkle a powder of special chemicals such as sodium chloride, sodium carbonate and the like over the burning site of the powder so as to suppress the violence of the fire though only incompletely. The efficiency of this method is, however, quite low as a practical method because the sprinkled amount of the agent has to be so large to suppress the violence of fire and, even when the fire in the surface layer of the piled metal powder has been seemingly extiguished, the core portion of the pile still remains at such a high temperature of red heat as to result in re-ignition of the powder on exposure to fresh air so that disposal of the powder even after fire extinguishment must usually be postponed for a long time, for example, of 60 minutes or even longer.

The dangerous materials of the second group, i.e. alkali metals such as sodium and potassium, are notoriously reactive with water to produce hydrogen gas and a large quantity of heat to cause spontaneous ignition so that alkali metals must be strictly kept away from water. Other conventional fire extinguishing agents such as carbon dioxide gas, Halons and powder fire extinguishing agents are also ineffective for extinguishment of fire involving an alkali metal. The only method for extinguishment of fire involving an alkali metal is to sprinkle dry sand over the burning site of the alkali metal although sprinkling of a powder of special chemicals such as sodium chloride, sodium carbonate and the like may have effectiveness in some cases. As a natural consequence of the principle of fire extinguishment with these conventional agents relying on the suffocating and cooling effects, a quite long time is taken for complete extinguishment of fire involving an alkali metal in addition to the disadvantage that a large amount of the fire extinguishing agent is required for complete extinguishment.

S. J. Rodgers, et al. have reported in MSA Res. Corp. First Quart. Progress Rept., Contract AF-33 (657)-8310, June 15, 1962 on the results of their experiments for extinguishment of fire involving each 1 g of an alkali metal such as lithium, sodium and potassium by sprinkling either one of 41 kinds of inorganic powdery materials. Their investigations have resulted in the proposal of powders of four kinds of materials including sodium carbonate, sodium chloride, potassium chloride and graphite as a practically effective fire extinguishing agent on an alkali metal. Although the above mentioned 41 kinds of powdery inorganic materials included boron oxide $B_2O_3$, no promising results could be obtained with boron oxide, presumably, because they undertook any controlling means for the purity of and moisture content in the boron oxide used as a fire extinguishing agent.

Namely, a conventional product of boron oxide usually contains at least a few % of water, which may be in the form of boric acid $H_3BO_3$. When such a water-containing boron oxide is sprinkled over a burning site of fire on an alkali metal, a loud noise of boiling is caused. This is presumably because, when the boron oxide is contacted with the alkali metal at a high temperature, the water contained in the boron oxide is decomposed and vaporized into water vapor a portion of which which in turn reacts with the alkali metal to produce explosive hydrogen gas. The inventor has noted in his experiments that, in the course of melting and vitrification of boron oxide sprinkled over fire, the water vapor produced forms a numberless large bubbles which subsequently coalesxe into larger ones in the molten boron oxide so that complete coverage of the burning site of the fire can never be obtained not to give an effect of fire extinguishment by suffocation as high as desired.

The dangerous material of the third group is a water-prohibiting solid material such as calcium carbide and calcium oxide. When these water-prohibiting materials are contacted with water, a large quantity of heat is evolved and or inflammable gases, such as acetylene, are produced to cause fire. These materials are sometimes reactive with most of conventional fire extinguishing agents. Therefore, these materials belong to the class of hardly fire-extinguishable materials in the absence of any effective method for fire extinguishment. The only means to have some effectiveness for fire extinguishment is sprinkling of dry sand over the burning site although the practical value of this method is relatively low due to the so large amount of the dry sand required for fire extinguishment in addition to the sometimes unavoidable incompleteness of extinguishment.

The dangerous material of the fourth group is a combustible solid materials such as red phosphorus, yellow phosphorus, sulfur and the like. These materials are readily ignited at a relatively low temperatures and burn at a high velocity. Some of them are toxic in themselves or may produce toxic gases in burning to cause troubles and difficulties in the fire extinguishment works thereof.

The dangerous material of the fifth group is a readily combustible liquid. Furthermore, some of them such as, for example, alkyl aluminums and chlorosilane compounds react violently with water so that water can never be used for extinguishment of fire involving these combustible liquids. Other conventional fire extinguishing agents such as carbon dioxide gas, Halons and powder fire extinguishing agents are absolutely or relatively ineffective for extinguishment of fire involving these combustible liquids.

SUMMARY OF THE INVENTION

The present invention accordingly has an object to provide a novel and effective method for extinguishment of fire involving either one of the dangerous combustible materials belonging to the above described first to fifth groups without the problems and disadvantages in the prior art methods Thus, the method of the present invention for fire extinguishment of a hardly extinguishable material comprising sprinkling of a powder of boron oxide, of which the content of $B_2O_3$ is at least 90% by weight and the content of water does not exceed 2% by weight, having a particle diameter ranging from 5 μm to 1000 μm over the burning site of the, hardly extinguishable material set on fire.

The effectiveness of the above described inventive method can be further improved by admixing the boron oxide with other auxiliary agents which may be effective to enhance the strength of the air-shielding boron oxide layer formed over the burning material or to absorb the burning material in a molten condition or in a liquid form.

DETAILED DESCRIPTION OF THE PREFERRED EMBODIMENTS

As is described above, the essential scope of the inventive method consists in the use of a specifically defined powder of boron oxide as a fire extinguishing agent to be sprinkled over the burning site of the dangerous combustible material. Namely, it is essential that the boron oxide has a purity of at least 90% by weight relative to the content of $B_2O_3$ and the content of water therein does not exceed 2% by weight or, preferably, does not exceed 0.5% by weight. It should be noted that even a boron oxide product of chemical reagent grade has a relatively low purity of about 85% by weight of $B_2O_3$ and content of water, which is probably in the form of boric acid, of about 10% by weight as specified in JIS (Japanese Industrial Standard). Such a boron oxide product is not usable as the fire extinguishing agent in the inventive method. An analytical grade product of boron oxide specified in JIS has a purity of 97% by weight of $B_2O_3$ and a water content of about 2% by weight and can be used in the inventive method when the water content does not exceed 2% by weight although the effectiveness obtained by sprinkling such a boron oxide powder is not so remarkable. Accordingly, it is preferable in order to obtain a remarkably improved effect of fire extinguishment to use a boron oxide powder obtained by drying such an analytical grade product of boron oxide by a heat treatment, for example, at 160° C. for 2 hours so that the water content therein is decreased to 0.5% by weight or lower by dehydration.

It is known that boric acid, which is a hydrate of boron oxide, can be dehydrated by heating while the process of dehydration proceeds stepwise as the temperature is increased according to the following equations:

$$H_3BO_3 \rightarrow HBO_2 + H_2O \text{ (at 100° C.);}$$

$$4HBO_3 \rightarrow H_2B_4O_7 + H_2O \text{ (at 140° C.); and}$$

$$H_2B_4O_7 \rightarrow 2B_2O_3 + H_2O \text{ (by red heating).}$$

Boron oxide in turn is hygroscopic and returns to boric acid by absorbing moisture in the atmospheric air according to the following equation:

$$B_2O_3 + 3H_2O \rightarrow 2H_3BO_3.$$

The above described reversibility between dehydration and re-hydration means that it would be an extremely difficult matter to obtain a completely anhydrous boron oxide. In other words, even a boron oxide powder of a very low water content is readily rehydrated in a moisture-containing atmosphere into boric acid unless the powder is stored under a special moisture-free condition.

The foregoing description gives an explanation of the reason for the use of a powder of anhydrous high-purity boron oxide as a fire extinguishing agent in the inventive method. In connection with the purity relative to the content of $B_2O_3$, it is optional or rather preferable that, if not responsible for an increase of overall amount of water even at an elevated temperature by decomposition, the boron oxide powder is blended with a minor amount of other inert inorganic powdery materials, for example, selected from the group consisting of talc, clay, mica flakes, feldspar powder, calcium orthophosphate and graphite powder, by which the powdery boron oxide can be prevented from consolidation and imparted with improved flowability to obtain great advantages in the practical use of the powder in the inventive method. It is not recommendable that the boron oxide powder is subjected to a surface treatment with a silicone oil and the like to impart moisture-proofness or hydrophobicity or blended with magnesium stearate and the like to improve the flowability of the powder because introduction of these organic materials is detrimental to a great extent against the performance of the boron oxide powder as a fire extinguishing agent of the dangerous hardly extinguishable materials.

It is also important that the boron oxide powder used as the fire extinguishing agent in the inventive method has a particle diameter in the range from 5 μm to 1000 μm. When the powder has a relatively small particle diameter, for example, in the range from 5 μm to 200 μm, the powder is suitable for filling a fire extinguisher. When the powder has a relatively large particle diameter, for example, in the range from 200 μm to 1000 μm. the powder is suitable for sprinkling by using a bucket, shovel and the like. When the boron oxide powder contains a substantial amount of particles having a particle diameter smaller than 5 μm, such fine particles may readily be drifted away when the powder is sprinkled over the burning site by the violence of fire thus to decrease the efficiency in the fire extinguishment if not to mention the trouble of environmental contamination by the particles scattered away. When the boron oxide powder contains a substantial amount of coarse particles having a particle diameter larger than 1000 μm, on the other hand, such coarse particles can be melted only after a long time so that the effect of fire extinguishment is exhibited delayedly or the fire can be extinguished only by sprinkling an increased amount of the boron oxide powder to cause an economical disadvantage.

As is well known, a fire extinguishment work is performed relying on four different principles either alone or as combined to exhibit a synergistic effect including (1) a removing effect which means that the combustible material is removed away from the burning site, (2) a suffocating effect which means that the combustible material is shielded from the supply source of oxygen, (3) the cooling effect which means that the temperature of the combustible material is decreased to the ignition temperature of the material or below by absorbing the heat of combustion so as to suppress the violence of burning, and (4) the suppressing effect which means that the chain reaction of combustion is chemically inhibited and suppressed. It is of course that most of fire extinguishment works rely on a synergistic combination of two more more of these four principles.

When a boron oxide powder having the above described properties is sprinkled over the burning site of the hardly extinguishable dangerous material belonging to either one or more of the first to fifth groups, the boron oxide powder is readily softened on or in the vicinity of the burning material since pure boron oxide $B_2O_3$ has a softening point of about 320° C. and particles of the boron oxide powder start to be sintered together with each other to form a crust when the temperature has reached 450° C. which is the melting point of pure boron oxide. The melting point of boron oxide is outstandingly low as compared with other inorganic heat-resistant materials. When melting of the boron oxide powder takes place, the particles of boron oxide are coalesced and then vitrified to form a glassy transparent layer. Advantageously and quite differently from most of other materials, the melt of boron oxide can retain a relatively high viscosity even when the temperature thereof is increased to exceed 1100° C. so that the layer of the molten boron oxide covering the burning material is free from flowing down even at such a high temperature to serve as a complete air-shielding layer by which the suffocating effect can be exhibited to a maximum extent leading to complete extinguishment of the fire. It is also noteworthy that the boiling point of boron oxide is as high as 2250° C. so that the loss of molten boron oxide by vaporization is negligibly small even at the highest temperature encountered in most of fires involving the hardly extinguishable dangerous materials. In addition, the heat of fusion of boron oxide is as large as 75.7 cal/g which is comparable even to the heat of fusion of ice which is 79.7 cal/g. This large heat of fusion is also significant from the standpoint of exhibiting the cooling effect in the fire extinguishment according to the inventive method because the sprinkled fire extinguishing agent absorbs a large quantity of heat of combustion from the burning material to lessen the violence of fire.

To give a more detailed description of the fire extinguishment works for a magnesium powder, which is a typical combustible metal of the first group burning with evolution of 146 kcal/mole of the heat of combustion, as an example, almost no recognizable noise of boiling is noted by sprinkling an anhydrous boron oxide powder of the above specified purity and particle diameter distribution and the powder is rapidly melted to decrease the temperature of the burning magnesium powder by the cooling effect. The molten particles of boron oxide first coalesced to form a crust layer and then a transparent vitreous layer is formed which completely covers the pile of the burning magnesium powder so that the violence of the fire rapidly subsides resulting in complete extinguishment of fire after a short while.

In contrast thereto, the efficiency of fire extinguishment by sprinkling a conventional powdery fire extinguishment agent, such as dry sand, sodium chloride, sodium carbonate, graphite and the like, is less effective by far because, even the violence of the fire has seemingly subsided in the surface layer of the powder pile, the core portion of the pile is still at a condition of red-heat and complete extinguishment of the fire can be achieved only after a long time of keeping the metal powder in this condition.

Moreover, an additional advantage is obtained with boron oxide, which has a relatively low specific gravity of only 1.84, over conventional powdery fire extinguishment agents having a specific gravity of 2 or larger because, even when the powder is sprinkled over a melt of a burning metal such as an alkali metal having a low specific gravity, the powder of boron oxide is relatively free from being lost by sinking into the melt of the burning metal as compared with other heavy powdery fire extinguishing agents.

It is preferable that the powder of boron oxide used in the inventive method is blended with a small amount of an inert inorganic powder selected from the group consisting of talc, clay, mica, feldspar, calcium orthophosphate and graphite with an object of preventing consolidation and improving flowability of the boron oxide powder. Blending of these inert inorganic powders has an additional secondary effect that the bulk density of the powdery fire extinguishing agent is decreased so as to enhance the efficiency of covering of the burning material more completely.

As is mentioned above, molten boron oxide has a high viscosity even at a high temperature. This unique property of boron oxide gives an unexpectedly high efficiency in the fire extinguishment works of fire in tanks and other structural bodies where the fire extinguishing agent is desired to cover the side surface of the tank and the like not in a horizontal disposition or even in a vertical disposition. In some instances, the fire extinguishing agent is desired to cover even a bottom surface of a body. Namely, a boron oxide powder blown at such a hot surface is readily and immediately melted on to the surface and the melt firmly adheres to the surface and forms a covering layer thereon to exhibit a surprising effect of fire extinguishment. Accordingly, the method of the invention is very efficienct even in a fire of an aircraft of which the body is constructed by using a large amount of magnesium or a magnesium alloy. Other conventional powdery fire extinguishing agents such as dry sand are absolutely ineffective in such a case.

When a water-prohibiting material belonging to the third group of the above given classification is involved in the fire, sprinkling of a powder of boron oxide does not lead to promotion of the fire violence because the burning material is never brought into contact with water contained in the fire extinguishing agent by virtue of the extremely low content of water in the boron oxide powder asprinkled according to the inventive method. When the boron oxide powder is sprinkled over the burning material, it is rapidly melted by the heat of combustion to form a viscous melt which effectively envelops the burning material to shield the material from any source of oxygen supply along with the cooling effect by the heat of fusion thereof so that the fire is rapidly subdued.

When a dangerous material such as sulfur belonging to the fourth group is involved in the fire, the material, which usually has a relatively low melting point, is in the most cases in a molten condition in the course of burning. A powder of boron oxide, having a relatively low melting point, as sprinkled is rapidly melted at the high temperature to form a glassy covering layer to exhibit the suffocating effect and cooling effect by taking the heat of fusion from the burning material leading to extinguishment of the fire although the boron oxide powder is partly included and dispersed in the melt of the burning material. The situation is also similar to the above in the extinguishment of the fire on a dangerous material belonging to the fifth group according to the classification.

As is mentioned above, blending of the boron oxide powder with an inert inorganic powder such as talc and the like is effective, along with the effects of prevention of consolidation of and improvement of the flowability of the boron oxide powder, in decreasing the apparent bulk density of the fire extinguishing agent to facilitate covering of the burning material with the melt of the boron oxide. In addition, such an inert inorganic powder intermixed with the melt of boron oxide has an effect of increasing the air-shielding coverage area with the same amount of boron oxide along with an efect of reinforcing the glassy covering layer formed of the melt of boron oxide.

Besides the above mentioned inert inorganic powdery materials as an additive to the boron oxide powder used in the inventive method, the investigations of the inventor have led to a further discovery that the fire extinguishing efficiency of the boron oxide powder can be further enahnced by blending the boron oxide powder with several classes of additives.

The first class of the additives includes a material having a relatively low melting point and capable of being eutectically melted with boron oxide so as to enhance the suffocating and cooling effects of boron oxide. Examples of the additive materials belonging to this class include sodium chloride, potassium chloride, anhydrous sodium carbonate, magnesium carbonate, anhydrous sodium tetraborate and the like.

The second class of the additives includes a material, though having a considerably high melting point, capable of being eutectically melted so as to reinforce the air-shielding layer by which the efficiency of fire extinguishment of molten boron oxide is further enhanced. Examples of the additive materials belonging to this class include silica sand, pulverized silica stone, quartz powder, calcium fluoride and the like.

The third class of the additives includes a material having a considerably high melting point but having an absorptive power for the burning material in a molten or liquid condition to exhibit the removing effect. Examples of the additive materials belonging to this class include porous silica powders, porous silica-alumina powders, kaolin, calcium carbonate, perlite and the like.

The above mentioned first class additive materials have a relatively low melting point, for example, in the range from 700° to 900° C. so that they are readily melted when brought into contact with the burning material or the flame at a high temperature. When the powdery additive material is in contact with molten boron oxide, the powder can be melted at a still lower temperature due to the eutectic effect with boron oxide so as to improve the covering effect of the burning material by the melt of the fire extinguishment agent. Moreover, these additive materials have a relatively large heat of fusion depriving the burning material of the heat of fusion to exhibit the cooling effect. The additive materials of this class to the boron oxide powder are particularly effective when the fire involves a burning material belonging to the first, second or fourth group according to the above given classification of dangerous materials.

Among the above mentioned second class additive materials, the siliceous materials, i.e. silica sand, pulverized silica stone and quartz powder, are each composed mainly of silica $SiO_2$ and used as a starting material of a heat-resistant glassy material as combined with boron oxide. When such a siliceous powder is mixed with a boron oxide powder and the blend is contacted with the burning material at a high temperature, fusion of the blend readily takes place even at a temperaure substantially lower than the melting point 1680° C. of silica to form a strong air-shielding glassy layer on the surface of the burning material and to increase the reliability of the fire extinguishment effect. Calcium fluoride is also highly heat-resistant and used frequently in various metallurgical processes as a flux. When a calcium fluoride is blended with a boron oxide powder, the melting point can be decreased. The additive materials of this class to the boron oxide powder are particularly effective when the fire involves a metal powder or magnesium in a bulky form.

The third class of the additives to the boron oxide powder include a heat-resistant porous or extrmely finely divided powder, When a blend of such a powder and a boron oxide powder is sprinkled over the burning site of an inflammable liquid or a combustible solid of low melting point, the powdery blend efficiently absorbs the liquid or melt of the burning material to exhibit the removing effect even at a low temperature. It is of course that the suffocating and cooling effects can be exhibited when the temperature is further increased by the melting of boron oxide as the principal ingredient of thr fire extinguishing agent.

The additives of the third class are also effective for fire involving a water-prohibitive dangerous material of the third group such as calcium carbide caused by contacting of the material with water. Namely, the additive of the third class in the powder blend can absorbs the water when the powder blend is sprinkled over the burning site of the fire to subdue the violence of the fire.

Thus, the additive materials of the third class are effective for extinguishment of the fire involving a dangerous material belonging to the third, fourth or fifth group of the dangerous materials according to the above given classification.

In the following, the requirements for the characteristic properties are described which the respective additive materials should possess. It is essential that the water content in these additive materials does not exceed 5% by weight or, preferably, 2% by weight.

The silica based porous powder should contain at least 80% by weight of $SiO_2$. The powder preferably has a pore diameter in the range from 0.1 μm to 100 μm, bulk density in the range from 0.2 to 0.5 g/cm$^3$ and particle diameter in the range from 5 μm to 1000 μm.

The silica-alumina based porous powder should contain at least 90% by weight of $SiO_2$ and $Al_2O_3$ as a total. The powder preferably has a pore diameter in the range from 1.0 μm to 100 μm, bulk density in the range from 0.3 g/cm$^3$ to 0.7 g/cm$^3$ and particle diameter in the range from 5 μm to 1000 μm. A heat-expanded perlite sand prepared from perlite rock is a particularly preferred species belonging to this class.

The silica sand, which may be a natural product as such or a product processed therefrom, should contain at least 90% by weight of $SiO_2$. The silica sand has a true density in the range from 2.5 g/cm$^3$ to 2.7 g/cm$^3$, and a particle diameter in the range from 1 μm to 500 μm.

The pulverized silica stone should contain at least 93% by weight of $SiO_2$. The silica sand has a true density in the range from 2.5 g/cm$^3$ to 2.65 g/cm$^3$ and a particle diameter in the range from 1 μm to 500 μm.

The kaolin used as the additive should be highly refractory and have a true density in the range from 2.55 g/cm$^3$ to 2.65 g/cm$^3$ and an average particle diameter in the range from 0.3 μm to 5 μm.

The sodium chloride, having a melting point of 801° C., should have a purity of at least 98% by weight of NaCl with a content of impurity magnesium salts as low as possible so as to be less hygroscopic. Moisture-proof treatment or addition of a consolidation-preventing agent is sometimes desirable in order to prevent consolidation of the salt particles by moisture absorption although use of a moisture-proofing agent or additive containing an organic matter should be avoided. The particle diameter of the salt is preferably in the range from 5 μm to 500 μm.

The potassium chloride, having a melting point of 776° C., should have a purity of at least 98% by weight of KCl with a content of impurity magnesium salts as low as possible so as to be less hygroscopic. Moisture-proof treatment or addition of a consolidation-preventing agent is sometimes desirable in order to prevent consolidation of the salt particles by moisture absorption although use of a moisture-proofing agent or additive containing an organic matter should be avoided. The particle diameter of the salt is preferably in the range from 5 μm to 500 μm.

The sodium carbonate, which should of course be anhydrous, preferably has a purity of at least 99% by weight of $Na_2CO_3$ and a particle diameter in the range from 5 μm to 500 μm.

The calcium carbonate preferably has a purity of at least 98% by weight of $CaCO_3$ and a particle diameter in the range from 1 μm to 200 μm.

The magnesium carbonate preferably has a purity of at least 97% by weight of $MgCO_3$ and a particle diameter in the range from 1 μm to 200 μm.

The calcium fluoride, which is the principal constituent of fluorspar, preferably has a purity of at least 98% by weight of $CaF_2$ and a particle diameter in the range from 1 μm to 500 μm. This material has a melting point of 1360° C. and is very stable.

The sodium tetraborate, which should of course be the anhydrous salt, preferably has a purity of at least 99% by weight of $Na_2B_4O_7$ and a particle diameter in the range from 5 μm to 1000 μm. This compound has a true density of 2.36 g/cm$^3$ and a melting point of 741° C.

It should be noted that, although it is conventional in the prior art that a powder fire extinguishing agent is imparted with moisture-proofness or hydrophobicity and increased flowability by a surface treatment with a silicone oil and the like or by the addition of magnesium stearate, these organic treatment agents and additives must be avoided because the organic matter contained therein greatly decreases the efficiency of fire extinguishment according to the inventive method.

In the following, examples are given to illustrate the method of the invention in more detail.

EXAMPLE 1

Three sheets of newspaper were spread one on another on a stainless steel-made dish having a diameter of 30 cm and 20 g of a magnesium powder were placed thereon at the center of the dish in a pile. The paper was set on fire and the magnesium powder was ignited by blowing the flame to the powder. When the fire had spread all over the pile of the magnesium powder, the burning site of the powder pile was shuffled so that the magnesium powder violently burned raising bright white flames with evolution of a large quantity of heat. At this moment a powder fire extinguishing agent was sprinkled over the burning magnesium powder and the effectiveness of fire extinguishment was observed. The results are described below.

Test No. 1

Powder: boron oxide, 98% $B_2O_3$, water content 0.5%, particle diameter 5 to 500 μm (referred to as the high-purity boron oxide powder hereinbelow)
Amount sprinkled: 18 g
Boiling noise: none
Smoke evolution: none
Flame suppression: good
Red-heated cinder in the core with the flame off: none
Note: strong glassy covering layer formed on the high temperature portion
Overall efficiency: excellent

Test No. 2

Powder: boron oxide, 97% $B_2O_3$, water content 2%, particle diameter 5 to 500 μm
Amount sprinkled: 22 g
Boiling noise: a little
Smoke evolution: a little
Flame suppression: good
Red-heated cinder in the core with the flame off: none
Note: strong half-molten covering layer formed on the high temperature portion
Overall efficiency: good

Test No. 3

Powder: the same boron oxide as in No. 2, surface-treated with silicone
Amount sprinkled: 24 g
Boiling noise: yes
Smoke evolution: yes
Flame suppression: effective
Red-heated cinder in the core with the flame off: none
Note: granular brittle covering layer formed on the high temperature portion Overall efficiency: poor Test No. 4

Powder: boron oxide, 85% $B_2O_3$, water content 10%, particle diameter 5 to 500 μm
Amount sprinkled: 25 g
Boiling noise: yes
Smoke evolution: large volume of smoke containing water vapor
Flame suppression: effective
Red-heated cinder in the core with the flame off: a little
Note: large voids in the covering layer
Overall efficiency: not to be used Test No. 5

Powder: sodium chloride-based commercial product
Amount sprinkled: 61 g
Boiling noise: yes
Smoke evolution: large volume of smoke with orange flames
Flame suppression: effective but delayedly
Red-heated cinder in the core with the flame off: none
Note: gas evolution from inside, smell of hydrogen sulfide, smoke evolution lasted prolongedly
Overall efficiency: poor Test No. 6

Powder: sodium carbonate-based commercial product
Amount sprinkled: 69 g
Boiling noise: yes
Smoke evolution: large volume of smoke with orange flames
Flame suppression: effective but delayedly
Red-heated cinder in the core with the flame off: none
Note: sludgy covering layer in direct contact with magnesium powder
Overall efficiency: poor Test No. 7

Powder: dry sand
Amount sprinkled: 80 g
Boiling noise: yes
Smoke evolution: a little
Flame suppression: effective
Red-heated cinder in the core with the flame off: yes
Note: boiling noise inside after suppression of the flame
Overall efficiency: not to be used As is summarized above, it is evident that the inventive method is particularly effective for extinguishment of fire of magnesium powder absolutely without boiling noises and smoke evolution to rapidly suppress the flames leading to complete fire extinguishment when the water content in the boron oxide is as small as 0.5%. Boron oxide powders containing 2% of water are also effective for extinguishment of fire of metallic magnesium though being accompanied by a little noise of boiling and a small volume of smoke evolution. A sufficient effect of fire extinguishment can be obtained by sprinkling the powder in an amount approximately equal to the amount of the burning magnesium powder.

When the boron oxide powder is surface-treated with a silicone oil to be imparted with hydrophobicity, however, the effectiveness of fire extinguishment is decreased even when the purity of the boron oxide powder is high enough. Boron oxide powders containing a large amount of water cannot be used for fire extinguishment. Conventional powder fire extinguishing agents are each quite ineffective as compared with the boron oxide powders because of the large boiling noises caused by sprinkling the powder and a large volume of smoke evolution taking a long time before suppression of the flame even when the sprinkled amount of the powder is more than three times by weight of the burning metal powder.

EXAMPLE 2

The testing procedure in each of the following tests was substantially the same as in Test No. 1 described above except that the boron oxide powder was blended with a powder of talc, clay, mica, feldspar, calcium orthophosphate, graphite or magnesium stearate as an additive. The results are summarized below.

Test No. 8

Powder: 90% boron oxide plus 10% talc
Amount sprinkled: 22 g
Boiling noise: slightly yes
Smoke evolution: none
Flame suppression: good
Red-heated cinder in the core with the flame off: none
Note: somewhat brittle granular crust layer formed on the high temperature portion
Overall efficiency: good Test No. 9

Powder: 93% boron oxide plus 7% clay
Amount sprinkled: 20 g
Boiling noise: none
Smoke evolution: none
Flame suppression: good
Red-heated cinder in the core with the flame off: none
Note: somewhat brittle crust layer formed on the high temperature portion
Overall efficiency: good Test No. 10

Powder: 93% boron oxide plus 7% mica powder
Amount sprinkled: 21 g
Boiling noise: none
Smoke evolution: none
Flame suppression: good
Red-heated cinder in the core with the flame off: none
Note: somewhat brittle crust layer formed on the high temperature portion
Overall efficiency: good Test No. 11

Powder: 93% boron oxide plus 7% feldspar
Amount sprinkled: 22 g
Boiling noise: slightly yes
Smoke evolution: none
Flame suppression: good
Red-heated cinder in the core with the flame off: none
Note: hard crust layer formed on the high temperature portion
Overall efficiency: good Test No. 12

Powder: 93% boron oxide plus 7% calcium orthophosphate
Amount sprinkled: 24 g
Boiling noise: none
Smoke evolution: a little
Flame suppression: good
Red-heated cinder in the core with the flame off: none
Note: hard translucent crust layer formed on the high temperature portion
Overall efficiency: good Test No. 13

Powder: 93% boron oxide plus 7% graphite
Amount sprinkled: 25 g
Boiling noise: slightly yes
Smoke evolution: none
Flame suppression: good
Red-heated cinder in the core with the flame off: none
Note: crust layer formed on the high temperature portion
Overall efficiency: good Test No. 14

Powder: 93% boron oxide plus 7% magnesium stearate
Amount sprinkled: 30 g
Boiling noise: a little
Smoke evolution: yes, with rising flames
Flame suppression: poor
Red-heated cinder in the core with the flame off: yes
Note: smoke and flame caused due to burning of the stearate
Overall efficiency: not to be used As is understood from the above summarized results, admixture of the boron oxide powder with an inert inorganic powder is effective for preventing consolidation of and improvement of the flowability of the boron oxide powder with little influence on the efficiency of fire extinguishment although the amount of the sprinkled powder is somewhat increased. In contrast thereto, admixture of magnesium stearate is detrimental against the effectiveness of the boron oxide powder as a fire extinguishing agent.

EXAMPLE 3

Tests of fire extinguishment similar to Tests No. 1 and No. 2 were undertaken by replacing the magnesium powder each with 20 g of a titanium powder or a zirconium powder. The results of the tests are summarized below.

Test No. 15

Material burnt: titanium powder
Powder: high-purity boron oxide
Amount sprinkled: 14 g
Boiling noise: none
Smoke evolution: none
Flame suppression: good
Red-heated cinder in the core with the flame off: none
Note: very hard and clear crust layer formed on the high temperature portion
Overall efficiency: excellent Test No. 16

Material burnt: titanium powder
Powder: boron oxide, the same as in Test No. 2
Amount sprinkled: 18 g
Boiling noise: a little
Smoke evolution: a little
Flame suppression: good
Red-heated cinder in the core with the flame off: none
Note: glassy layer formed on the high temperature portion
Overall efficiency: good Test No. 17

Material burnt: zirconium powder
Powder: high-purity boron oxide
Amount sprinkled: 21 g
Boiling noise: none
Smoke evolution: a little
Flame suppression: good
Red-heated cinder in the core with the flame off: none
Note: glassy layer formed on the high temperature portion
Overall efficiency: good Test No. 18

Material burnt: zirconium powder
Powder: boron oxide, the same as in Test No. 2
Amount sprinkled: 28 g
Boiling noise: a little
Smoke evolution: a little
Flame suppression: good
Red-heated cinder in the core with the flame off: none
Note: glassy layer formed on the high temperature portion
Overall efficiency: good As is understood from the above summarized results, the inventive method is effective for extinguishment of fire of burning powders of titanium and zirconium. Needless to say, the inventive method is more effective for extinguishment of fire of burning powders of aluminum, zinc, iron and the like having a higher ignition point than magnesium, titanium and zirconium although no data are given here.

EXAMPLE 4

A sheet of cotton gauze wet with water was spread on the bottom surface of a stainless steel-made small vessel and a piece of metallic sodium weighing about 5 g was put thereon to cause spontaneous ignition. The fire was extinguished by sprinkling a boron oxide powder or dry sand. The results are summarized below.

Test No. 19

Powder: high-purity boron oxide
Amount sprinkled: 9 g
Time taken for extinguishment: 15 seconds
Note: no noise caused by sprinkling of the powder, surface covered by the melt of the powder, rapid extinguishment Test No. 20

Powder: boron oxide, the same as in Test No. 2
Amount sprinkled: 11 g
Time taken for extinguishment: 20 seconds Note: a little noise by sprinkling of the powder Test No. 21

Powder: dry sand
Amount sprinkled: 50 g
Time taken for extinguishment: 30 seconds
Note: boiling noise by sprinkling of the powder The above summarized results give a conclusion that only a much smaller amount of a boron oxide powder is sufficient for extinguishment of fire of metallic sodium than conventional dry sand with no or only a little boiling noise caused thereby.

EXAMPLE 5

A 20 g portion of calcium carbide was put on the bottom surface of a stainless steel-made vessel having an inner diameter of 10 cm and a depth of 6 cm and 10 ml of water were poured thereto to generate acetylene gas. The acetylene gas was set on fire and, after 20 seconds of uncontrolled burning, the fire was extinguished according to the inventive method. The results were as follows:

Test No. 22

Powder: high-purity boron oxide
Amount sprinkled: 23 g
Noise: none
Smoke evolution: none
Flame suppression: good
Time taken for extinguishment: 30 seconds
Note: brittle crust layer formed
Overall efficiency: good

EXAMPLE 6

A 20 g portion of red phosphorus or sulfur was put on the same stainless steel-made dish as used in Example 1 and ignited by using a gas torch lamp. After 20 seconds of uncontrolled burning, the fire was extinguished by sprinkling a boron oxide powder. The results were as follows:

Test No. 23

Material burnt: red phosphorus
Powder: high-purity boron oxide
Amount sprinkled: 20 g
Noise: none
Smoke evolution: yes
Flame suppression: good
Time taken for extinguishment: 40 seconds
Note: the powder not melted due to low violence of fire
Overall efficiency: good Test No. 24

Material burnt: sulfur
Powder: high-purity boron oxide
Amount sprinkled: 22 g
Noise: none
Smoke evolution: a little
Flame suppression: good
Time taken for extinguishment: 25 seconds
Overall efficiency: good

EXAMPLE 7

The procedure of testing was substantially the same as in Example 6 except that the powder of the boron oxide was blended with a silica-based porous powder containing 89% of $SiO_2$ and having a particle diameter of 5 to 500 μm. The results were as follows.

Test No. 25

Material burnt: red phosphorus
Powder: 90% high-purity boron oxide plus 10% porous silica powder
Amount sprinkled: 18 g
Noise: none
Smoke evolution: yes
Flame suppression: good
Time taken for extinguishment: 35 seconds
Overall efficiency: good Test No. 26

Material burnt: sulfur
Powder: 90% high-purity boron oxide plus 10% porous silica powder
Amount sprinkled: 20 g
Noise: none
Smoke evolution: a little
Flame suppression: good
Time taken for extinguishment: 20 seconds
Overall efficiency: good As is understood from the comparison of the results obtained in Example 6 and Example 7, blending of a silica-based porous powder to the high-purity boron oxide powder has an effect of further enhancing the efficiency of the powder for extinguishment of fire of red phosphorus or sulfur which burns in a molten condition. Namely, the time taken for extinguishment of the fire can be decreased by 10 to 20% by blending the boron oxide powder with the silica-based porous powder. Similar improvements can be obtained by replacing the silica-based porous powder with a silica.alumina-based porous powder.

EXAMPLE 8.

The same testing procedure as in Example 5 was repeated except that the high-purity boron oxide powder was blended with the same silica-based porous powder as used in Example 7. The results were as shown below.

Test No. 27

Powder: 90% high-purity boron oxide plus 10% porous silica powder
Amount sprinkled: 14 g
Noise: none
Smoke evolution: none
Flame suppression: good
Time taken for extinguishment: 20 seconds
Overall efficiency: excellent As is understood from the comparison of the results of Example 5 and Example 8, blending of the silica-based porous powder with the high-purity boron oxide powder is effective to further enhance the effectiveness of the inventive method for extinguishment of fire caused by calcium carbide contacted with water because the silica-based porous powder is capable of absorbing water in the absence of which no fire would take place.

EXAMPLE 9.

The testing procedure in each of the following tests was substantially the same as in Test No. 1 excepting omission of the sheets of newspaper spread on the stainless steel-made dish and blending of the high-purity boron oxide powder with an additive powder. The results are summarized below.

Test No. 28

Powder: 90% high-purity boron oxide plus 10% sodium chloride
Amount sprinkled: 22 g
Noise: a little
Smoke evolution: none
Flame suppression: good
Red-heated cinder in the core with the flame off: none
Note: crust layer formed on the high temperature portion
Overall efficiency: good Test No. 29

Powder: 90% high-purity boron oxide plus 10% potassium chloride
Amount sprinkled: 21 g
Noise: bursting noise
Smoke evolution: none
Flame suppression: good
Red-heated cinder in the core with the flame off: none
Note: half-molten glassy layer formed on the high temperature portion
Overall efficiency: good Test No. 30

Powder: 90% high-purity boron oxide plus 10% sodium carbonate
Amount sprinkled: 22 g
Noise: none
Smoke evolution: none but orange flames
Flame suppression: good
Red-heated cinder in the core with the flame off: none
Note: crust layer formed on the high temperature portion
Overall efficiency: good Test No. 31

Powder: 90% high-purity boron oxide plus 10% magnesium carbonate
Amount sprinkled: 22 g
Noise: yes
Smoke evolution: a little
Flame suppression: good
Red-heated cinder in the core with the flame off: none
Note: crust layer formed on the high temperature portion
Overall efficiency: good Test No. 32

Powder: 90% high-purity boron oxide plus 10% sodium tetraborate
Amount sprinkled: 21 g
Noise: yes
Smoke evolution: a little
Flame suppression: good
Red-heated cinder in the core with the flame off: none
Note: crust layer formed on the high temperature portion
Overall efficiency: good The additives used in the above described tests have an effect of increasing the flowability of the melt of boron oxide so that the melt in a semi-molten condition can spread over the surface of the burning material at a relatively low temperature to further enhance the efficiency of fire extinguishment according to the inventive method.

EXAMPLE 10.

The testing procedure in each of the following tests was substantially the same as in Example 9 except that the additive to the high-purity boron oxide powder was a siliceous powder or calcium fluoride. The results were as summarized below.

Test No. 33

Powder: 90% high-purity boron oxide plus 10% silica sand containing 95% $SiO_2$
Amount sprinkled: 20 g
Noise: none
Smoke evolution: none
Flame suppression: good
Red-heated cinder in the core with the flame off: none
Note: translucent, porcelain enamel-like layer formed on the high temperature portion
Overall efficiency: excellent Test No. 34

Powder: 90% high-purity boron oxide plus 10% pulverized silica stone containing 97% $SiO_2$
Amount sprinkled: 20 g
Noise: none
Smoke evolution: none
Flame suppression: good
Red-heated cinder in the core with the flame off: none
Note: very hard crust layer formed on the high temperature portion
Overall efficiency: excellent Test No. 35

Powder: 90% high-purity boron oxide plus 10% quartz powder containing 90% $SiO_2$
Amount sprinkled: 20 g
Noise: none
Smoke evolution: none
Flame suppression: good
Red-heated cinder in the core with the flame off: none
Note: crust layer formed on the high temperature portion
Overall efficiency: good Test No. 36

Powder: 90% high-purity boron oxide plus 10% calcium fluoride
Amount sprinkled: 20 g
Noise: none
Smoke evolution: none
Flame suppression: good
Red-heated cinder in the core with the flame off: none
Note: brittle crust layer formed on the high temperature portion Overall efficiency: good It is noted that blending of the high-purity boron oxide powder with an additive powder having a melting point much higher than that of boron oxide, i.e. 1680° C. for silica and 1360° C. for calcium fluoride, is effective for reinforcing the molten or semi-molten crust layer to further enhance the reliability of air shielding power of the layer leading to rapid extinguishment of the fire.

EXAMPLE 11.

A 30 ml portion of triethyl aluminum or a 50 ml portion of trichlorosilane was taken in the same stainless steel-made vessel as used in Example 5 and the liquid was ignited. After 30 seconds of uncontrolled burning, the fire was extinguished by sprinkling a powder fire extinguishingt agent according to the invention prepared by blending the high-purity boron oxide powder with an equal amount of the same silica-based porous powder as used in Test No. 27. The results were as shown below.

Test No. 37

Material burnt: triethyl aluminum
Powder: 50% high-purity boron oxide plus 50% silica-based porous powder
Amount sprinkled: 50 g
Time taken for extinguishment: 50 seconds
Note: no crust layer formed
Overall efficiency: good

Test No. 38

Powder: 50% high-purity boron oxide plus 50% silica-based porous powder
Amount sprinkled: 125 g
Boiling noise: a little
Flame suppression: good
Time taken for extinguishment: 25 seconds
Overall efficiency: good As is described above, sprinkling of a blend of a high-purity boron oxide powder and a silica-based porous powder is effective for extinguishing fire of triethyl aluminum or trichlorosilane, of which fire can hardly be extinguished by using any conventional fire extinguishing agent.

It is an alternative way for efficient fire extinguishment of such a hardly extinguishable liquid dangerou material that a silica-based porous powder is first sprinkled to cover the liquid surface so that the liquid is absorbed by the powder and the high-purity boron oxide powder is sprinkled after the surface layer of the silica-based porous powder has reached the melting point of the boron oxide powder to form an air-shielding layer of the molten boron oxide.

EXAMPLE 12.

A magnesium metal plate of 10 cm wide, 30 cm long and 5 mm thick was stood lengthwise in an approximately vertical disposition by leaning against a wall of refractory bricks and ignited by usng a gas torch lamp. When the area of the plate under violent burning had been enlarged over about a half of the plate, a powder fire extinguishing agent was sprinkled over the burning surface. The powders tested included a blend of the high-purity boron oxide powder and a pulverized silica stone containing 97% of $SiO_2$ and having a particle diameter of 10 to 150 μm and the two commercial product used in Tests No. 5 and No. 6. The results of the tests were as follows.

Test No. 39

Powder: 97% high-purity boron oxide plus 3% pulverized silica stone
Noise: none
Smoke evolution: none
Flame suppression: good
Time taken for extinguishment: 15 seconds
Note: melt of the powder adhering to the vertical surface forming a layer of about 1 mm thick
Overall efficiency: excellent

Test No. 40

Powder: sodium chloride-based commercial product
Noise: yes
Smoke evolution: a very large volume of smoke evolved
Flame suppression: no, flames in orange color
Time taken for extinguishment: not extinguishable
Note: most of the particles falling without adhering to the burning surface, unpleasant odor
Overall efficiency: not to be used

Test No. 41

Powder: sodium carbonate-based commercial product
Noise: large bursting noises
Smoke evolution: a large volume of smoke evolved
Flame suppression: no, high orange flames
Time taken for extinguishment: no extinguishable
Note: most of the particles falling without adhering to the burning surface,
Overall efficiency: not to be used As is evidenced by the tests, conventional powder fire extinguishing agents for fire of metal are quite ineffective when the surface of the burning metal body is in a vertical disposition because the particles blown at the surface mostly fall without adhering to the burning surface while, on the other hand, boron oxide powders according to the inventive method are deposited on the metal surface at a high temperasture where the particles are rapidly melted to form an air-shielding layer which exhibits the effect of fire extinguishment.

It is a presumption that the particles of boron oxide powder adhere well to the surface even in a vertical disposition because boron oxide has a high specific resistivity of $2.6\times10^{16}$ ohm.cm at 25° C. and an adequate particle diameter so that the particles are readily charged electrostatically when the powder is sprinkled or ejected from a container and also because boron oxide has a relatively low melting point of 450° C. so that the particles are melted and vitrified easily to form droplets of viscous liquid. Moreover, the melt of high-purity boron oxide retains the high viscosity even at a very high temperature of 1100° C. or above so as to readily adhere to the surface of a metal, which in fact is substantially covered with an oxide layer, absolutely without falling therefrom not only in the fire extinguishment works but also after the fire has been extinguished.

The above described unique properties of a high-purity boron oxide powder well explain the reason for the advantages obtained by the inventive method which is applicable, for example, to extinguishment of fires of an aircraft which is constructed using a large amount of magnesium-containing alloys and has surfaces in a vertical disposition or facing downwardly as the objective surfaces of the fire extinguishment works.

EXAMPLE 13.

One kg of a magnesium powder was taken on and spread over a stainless steel-made dish having a diameter of 50 cm and ignited by using a gas torch lamp. When the fire had spread allover the surface of the layer of the magnesium powder, the powder was gently shuffled so that violent burning of the magnesium powder started raising bright white flames. Then, a powder fire extinguishing agent indicated below, which was a blend of the high-purity boron oxide powder and a natural silica powder containing 99% $SiO_2$ and having a partcle diameter of 5 to 200 μm or a commercial product, was sprinked thereover from a portable fire extinguisher of Model #20 to extinguish the fire. The results are summarized below, from which it is evident that the method according to the invention is much more effective than the method of using a conventional fire extinguishing agent. When the fire extinguishing agent sprinkled was the high-purity boron oxide powder alone, the time taken for complete extinguishment of fire was extended to 20 seconds indicating the effectiveness of the silica powder blended with the high-purity boron oxide powder.

Test No. 42

Powder: 95% high-purity boron oxide plus 5% natural silica powder
Amount sprinkled: 1000 g
Smoke evolution: none
Flame suppression: good
Time taken for extinguishment: 11 seconds
Note: no powder scattered around
Overall efficiency: excellent Test No. 43

Powder: sodium chloride-based commercial product
Amount sprinkled: 3600 g
Smoke evolution: large volume
Flame suppression: effective but delayedly
Time taken for extinguishment: 92 seconds
Note: large amount of powder scattered around, unpleasant odor
Overall efficiency: poor Test No. 44

Powder: sodium carbonate-based commercial product
Amount sprinkled: 2300 g
Smoke evolution: yes
Flame suppression: effective but flames rose against after a while
Time taken for extinguishment: 41 seconds
Note: powder scattered around
Overall efficiency: poor

What is claimed is:

1. A method for extinguishment of a difficult to extinguish material which comprises sprinkling, over the burning site of the material, a blend of a boron oxide powder having a purity relative to the content of $B_2O_3$ of at least 90% by weight and containing water in an amount not exceeding 2% by weight, the particles of the powder having a diameter in the range from 5 μm to 1000 μm and an inorganic additive powder selected from the group consisting of sodium chloride, potassium chloride, sodium carbonate, magnesium carbonate and anhydrous sodium tetraborate.

2. The method for extinguishment of fire of a difficult to extinguish material as claimed in claim 1 wherein the boron oxide powder is blended with another inorganic additive powder selected from the group consisting of talc, clay, mica, fieldspar, calcium orthophosphate and graphite.

3. The method for extinguishment of fire of a difficult to extinguish material as claimed in claim 2 wherein the amount of the other inorganic additive powder is in the range from 1 to 20% by weight based on the amount of the boron oxide powder.

4. The method for extinguishment of fire of a difficult to extinguish material as claimed in claim 1 wherein the amount of the inorganic additive powder is in the range from 1 to 30% by weight based on the amount of the boron oxide powder.

5. The method for extinguishment of fire of a difficult to extinguish material as claimed in claim 1 wherein the boron oxide powder is blended with a second inorganic additive powder selected from the group consisting of silica sand, pulverized silica stone, quartz powder and calcium fluoride.

6. The method for extinguishment of fire of a difficult to extinguish material as claimed in claim 1 wherein the amount of the second inorganic additive powder is in the range from 1 to 30% by weight based on the amount of the boron oxide powder.

7. The method for extinguishment of fire of a difficult to extinguish material as claimed in claim 1 wherein the boron oxide powder is blended with a third inorganic additive powder selected from the group consisting of a silica-based porous powder, silica.alumina-based porous powder, kaolin, calcium carbonate and perlite.

8. The method for extinguishment of fire of a difficult to extinguish material as claimed in claim 7 wherein the amount of the third inorganic additive powder is in the range from 1 to 90% by weight based on the amount of the boron oxide powder.

9. A method for extinguishment of fire of a difficult to extinguish material which comprises sprinkling, over the burning site of the material, a powdery fire extinguishing agent comprising a boron oxide powder having a purity relative to the content of $B_2O_3$ of at least 90% by weight and containing water in an amount not exceeding 2% by weight, the particles of the powder having a diameter in the range from 5 μm to 1000 μm as the principle constituent, with admixture of at least one additive powder selected from the group consisting of:

(a) a first additive powder capable of exhibiting a suffocating and cooling effect on the fire by eutectically melting with boron oxide to decrease the melting point thereof selected from the group consisting of sodium chloride, potassium chloride, sodium carbonate, magnesium carbonate and anhydrous sodium tetraborate;

(b) a second additive powder capable of forming a suffocating and shielding layer having a high strength; and (c) a third additive powder capable of absorbing a liquid burning material to exhibit a removing and suffocating effect.

10. The method for extinguishment of fire of a difficult to extinguish material as claimed in claim 9 wherein the second additive powder is selected from the group consisting of silica sand, pulverized silica stone, quartz powder and calcium fluoride.

11. The method for extinguishment of fire of a difficult to extinguish material as claimed in claim 9 wherein the third additive powder is selected from the group consisting of a silica-based porous powder, silica-alumina-based porous powder, kaolin, calcium carbonate and perlite.

12. A powdery fire extinguishing agent which comprises a boron oxide powder having a purity relative to the content of $B_2O_3$ of at least 90% by weight and containing water in an amount not exceeding 2% by weight, the particles of the powder having a diameter in the range from 5 μm to 1000 μm as the principal constituent, with admixture of at least one additive powder selected from the group consisting of:

(a) a first additive powder capable of exhibiting a suffocating and cooling effect on the fire by eutectically melting with boron oxide to decrease the melting point thereof selected from the group consisting of sodium chloride, potassium chloride, sodium carbonate, magnesium carbonate and anhydrous sodium tetraborate;

(b) a second additive powder capable of forming a suffocating and shielding layer having a high strength; and (c) a third additive powder capable of absorbing a liquid burning material to exhibit a removing and suffocating effect.

13. The powdery fire extinguishing agent as claimed in claim 12 wherein the second additive powder is selected from the group consisting of silica sand, pulverized silica stone, quartz powder and calcium fluoride.

14. The powdery fire extinguishing agent as claimed in claim 10 wherein the third additive powder is selected from the group consisting of a silica-based porous powder, silica-alumina-based porous powder, kaolin, calcium carbonate and perlite.

* * * * *